US011740049B2

(12) United States Patent
Schwieger et al.

(10) Patent No.: US 11,740,049 B2
(45) Date of Patent: Aug. 29, 2023

(54) RECOIL BRAKE AND BARRELED FIREARM

(71) Applicant: Rheinmetall Waffe Munition GmbH, Suedheide (DE)

(72) Inventors: Florian Schwieger, Ebstorf (DE); Berthold Baumann, Eschede (DE); Reinhard Dollak, Nienhagen-Papenhorst (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/671,255

(22) Filed: Feb. 14, 2022

(65) Prior Publication Data

US 2022/0325975 A1 Oct. 13, 2022

Related U.S. Application Data

(63) Continuation of application No. PCT/EP2020/070554, filed on Jul. 21, 2020.

(51) Int. Cl.
*F41A 25/02* (2006.01)

(52) U.S. Cl.
CPC ..... *F41A 25/02* (2013.01)

(58) Field of Classification Search
CPC ..... F41A 25/02
USPC ..... 89/43.01, 177, 198
See application file for complete search history.

(56) References Cited

U.S. PATENT DOCUMENTS 565,607 A * 8/1896 Deport ..... F41A 25/02 89/43.01
782,469 A * 2/1905 Schneider ..... F41A 25/02 89/43.01
2,735,670 A * 2/1956 Schultze ..... F16F 9/185 267/225
3,410,174 A 11/1968 Hahn
(Continued)

FOREIGN PATENT DOCUMENTS

DE 490157 C * 1/1930 ..... F41A 25/02
DE 710301 C 9/1941
(Continued)

OTHER PUBLICATIONS

International Search Report dated Oct. 30, 2020 in corresponding application PCT/EP2020/070554.
(Continued)

*Primary Examiner* — Bret Hayes
(74) *Attorney, Agent, or Firm* — Muncy, Geissler, Olds & Lowe, P.C.

(57) ABSTRACT

A recoil brake for braking recoiling masses of a barreled firearm, comprising a hollow cylinder, which has an interior filled with a fluid and having a high-pressure side and a low-pressure side, a control rod arranged in the hollow cylinder, which has an end connected to the hollow cylinder, a piston rod surrounding the control rod, which is arranged within the hollow cylinder for movement in an axial direction of the hollow cylinder, a piston being formed on the piston rod, which is arranged for displacement in the axial direction and which fluidically separates the high-pressure side from the low-pressure side. A distance by which the piston is displaceable in the axial direction is at least as great as the recoil distance of the recoiling masses during a passage of a bullet through the barreled firearm.

11 Claims, 1 Drawing Sheet

(56) References Cited

U.S. PATENT DOCUMENTS

| | | | | | |
|---|---|---|---|---|---|
| 4,502,366 | A | | 3/1985 | Metz et al. | |
| 4,774,873 | A | * | 10/1988 | Shoales | F41A 25/20<br>89/43.01 |
| 4,924,751 | A | | 5/1990 | Metz et al. | |

FOREIGN PATENT DOCUMENTS

| | | | | | |
|---|---|---|---|---|---|
| DE | 737376 | C | | 7/1943 | |
| DE | 1283706 | B | | 11/1968 | |
| DE | 2943083 | B1 | | 3/1981 | |
| DE | 3015126 | A1 | | 9/1983 | |
| DE | 102017103052 | A1 | * | 8/2018 | F41A 25/02 |
| DE | 102017103052 | A1 | | 8/2018 | |
| EP | 0351501 | A1 | | 1/1990 | |
| GB | 191513247 | A | | 3/1919 | |

OTHER PUBLICATIONS

International Preliminary Report on Patentability dated Feb. 24, 2020 in corresponding application PCT/EP2020/070554.

* cited by examiner

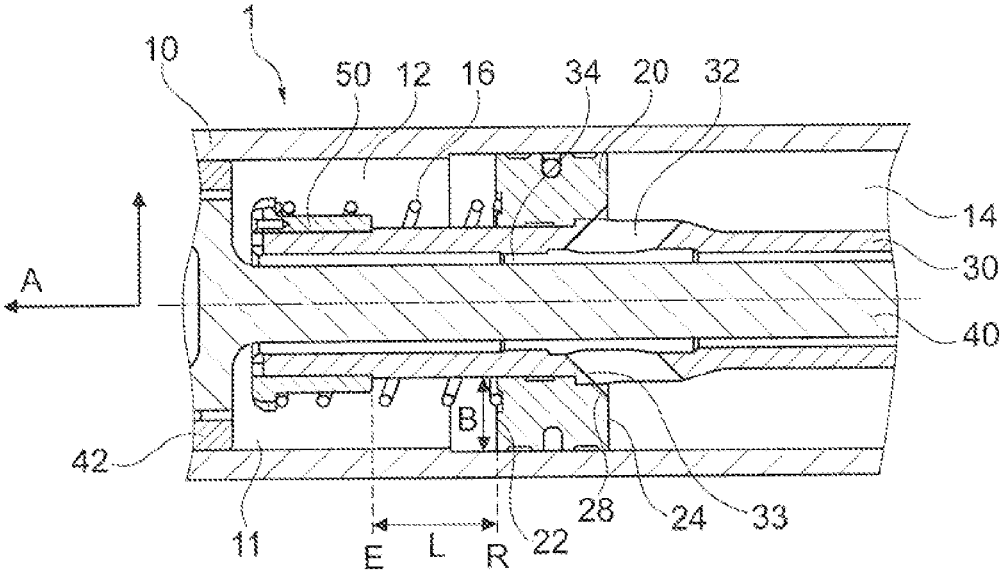
1
10
50
12
16
34
20
32
14
30
A
40
B
42
11
E
L
R
22
28
24
33

RECOIL BRAKE AND BARRELED FIREARM

This nonprovisional application is a continuation of International Application No. PCT/EP2020/070554, which was filed on Jul. 21, 2020, and which claims priority to German Patent Application No. 10 2019 121 982.5, which was filed in Germany on Aug. 15, 2019, and which are both herein incorporated by reference.

BACKGROUND OF THE INVENTION

Field of the Invention

The present invention relates to a recoil brake for braking recoiling masses of a barreled firearm, comprising a hollow cylinder, which has an interior filled with a fluid, a control rod arranged in the hollow cylinder, which has an end connected to the hollow cylinder, and a piston rod surrounding the control rod, which is arranged within the hollow cylinder for movement in the axial direction of the hollow cylinder. The application further relates to a barreled firearm, in particular a large-caliber firearm, which comprises at least one recoil brake of this type.

Description of the Background Art

For the precision of barreled firearms and, in particular, large-caliber barreled firearms, it is important that the firearm barrel is preferably not stimulated to vibrations during the passage of a bullet. Today's large-caliber firearm barrels have a firearm recoil, which is braked by recoil brakes. The braking force is usually generated by a hydraulic brake, depending on the distance of the firearm recoil. A hydraulic fluid is pressed through a control gap. The control gap is variable with the recoil and controls the braking force in this manner.

A recoil brake is known from DE 10 2017 103 052 A1, which is incorporated herein by reference, and which includes a hollow cylinder filled with fluid. A movable piston rod and a control rod arranged within the piston rod are situated within the hollow cylinder. The control rod has a variable control profile.

A hydropneumatic recuperator and a recoil brake for a recoil gun are known from DE 30 15 126 A1, which is incorporated by reference, and in which a piston rod is formed in a hollow cylinder, which has a piston fixedly connected to the piston rod.

U.S. Pat. No. 4,502,366, which is incorporated herein by reference, and DE 29 43 083 B1 disclose a hydraulic recoil brake, which includes a hydraulic cylinder and a piston rod arranged therein.

A recoil brake is known from EP 0 351 501 A1, which corresponds to U.S. Pat. No. 4,924,751, which is incorporated herein by reference. The recoil brake comprises a hollow cylinder filled with fluid. A control rod is arranged in the hollow cylinder, and one end of the control rod is connected to the hollow cylinder. A piston rod is formed around the control rod, which forms a single piece with the piston and is movable within the hollow cylinder. When a bullet is fired and passes through the firearm barrel, the firearm barrel moves backward. The brake piston formed as a single piece with the piston rod generates a braking force in the meantime. The recoil brake further includes a piston ring behind the piston. The piston and the piston ring have a bore, so that the high-pressure side and the low-pressure side are connected by the piston and the piston ring in the idle position thereof. The bore is designed for throttling a counterrecoil.

Due to the design of the known firearm brakes, a braking force is generated while the bullet is passing through the firearm barrel, which acts upon the firearm barrel, which results in a stimulation of the firearm barrel to vibrations. This has negative effects on the precision of the firearm.

SUMMARY OF THE INVENTION

It is therefore an object of the present invention to provide a recoil brake, which permits a free recoil of the firearm barrel while the bullet is still in the firearm barrel.

According to an exemplary embodiment of the invention, a recoil brake is provided for braking recoiling masses of a barreled firearm, comprising a hollow cylinder, which has an interior filled with a fluid, a control rod arranged in the hollow cylinder, which has an end connected to the hollow cylinder, a piston rod surrounding the control rod, which is arranged within the hollow cylinder for movement in the axial direction of the hollow cylinder, a piston being formed on the piston rod which is arranged for displacement in the axial direction and which fluidically separates a high-pressure side from a low-pressure side of the interior.

A barreled firearm can be furthermore provided, which includes at least one recoil brake of this type or refined as described below.

The barreled firearm can be a firearm which usually includes one or multiple recoil brakes. A firearm of this type is preferably a medium-caliber or large-caliber firearm.

The recoiling masses are the parts of the barreled firearm which are deflected against the shooting direction, due to recoil. These include, for example, the firearm barrel and the breechblock.

The end of the control rod can be circumferentially connected to the hollow cylinder.

The hollow cylinder has the high-pressure side and the low-pressure side. While the firearm barrel is being braked by the recoil brake, and the piston rod, together with the piston, is moving through the hollow cylinder, the pressure is higher on the high-pressure side than on the low-pressure side.

The hollow cylinder of the recoil brake can be connected to the cradle of the barreled firearm, and the piston rod can be connected to the recoiling masses of the firearm. However, it is also possible that the recoil brake is connected to the recoiling masses of the firearm and the piston rod is connected to the cradle.

The piston rod is movable within the hollow cylinder in the axial direction of the hollow cylinder.

The piston is arranged on the piston rod for displacement in the axial direction of the hollow cylinder.

This achieves the fact that the firearm barrel may carry out a free recoil while a fired bullet is passing through the firearm barrel. During this process, the recoil brake has no braking effect. The braking effect of the recoil brake sets in only after the bullet has left the firearm barrel. A low residual braking force is also prevented by the recoil brake. This achieves the fact that the firearm barrel is stimulated to vibrations as little as possible during the passage of the bullet. This has a positive effect on the precision of the barreled firearm.

In an example of the recoil brake, it may be provided that the piston fluidically separates the high-pressure side from the low-pressure side in such a way that a fluidic communication between the high-pressure side and the low-pressure side through the piston is prevented, in particular in an area between an outer contour of the piston rod and an inner contour of the hollow cylinder. This achieves the fact that the piston is able to move freely on the piston rod without the fluid being able to flow through the piston between an outer contour of the piston rod and an inner contour of the hollow cylinder. The piston seals this area between the outer contour of the piston rod and an inner contour of the hollow cylinder.

The fluid is preferably a hydraulic fluid.

The recoil brake may further provide that the distance by which by the piston is axially displaceable in the axial direction, is at least as great as the recoil distance of the recoiling masses during the passage of a bullet through the barreled firearm.

This ensures that a bullet has left the firearm barrel before the recoil brake engages, so that the firearm barrel of a barreled firearm is stimulated to vibrations as little as possible.

In an example of the recoil brake, it may further be provided that the piston has two essentially radially running end faces. A more compact design of the piston and a uniform pressure distribution over the piston are ensured hereby. In addition, structural weaknesses are avoided, and a good sealing effect is achieved.

The recoil brake may preferably be designed in such a way that the piston has a high-pressure-side end face, whose entire end face corresponds to the high-pressure side in an idle position. It may further be provided that the end face also corresponds to the high-pressure side in a stop position and a position between the idle position and the stop position.

The recoil brake may provide that the piston has a low-pressure-side end face, whose entire end face corresponds to the low-pressure side at all times.

It may further be provided that the piston rod has an essentially cylindrical outer contour over its entire length. This achieves the fact that an axial displaceability of the piston is possible over a great distance. Comparatively slow bullets may thus also leave the firearm barrel before the braking effect of the recoil brake sets in.

A control gap can be formed within the piston rod, in particular between the piston rod and the control rod, which connects the high-pressure side and the low-pressure side, the piston rod having at least one opening, which connects the high-pressure side and the control gap to each other.

The opening can be arranged in front of an idle position of the piston.

The opening may also be arranged behind an idle position of the piston, so that the opening is only exposed when the piston has passed the opening.

This achieves the fact that the fluid is only able to flow through the control gap from the high-pressure side to the low pressure side during the braking operation, and a defined braking effect thus sets in, due to the dimensioning of the control gap.

An idle position can be understood to be the position of a displaceably arranged piston, in which the piston is situated before firing.

It may further be provided that the control gap communicates with the high-pressure side and the low-pressure side in the idle position of the piston. For this purpose, the control gap can have an opening which is connected to the high-pressure side, and an opening which is connected to the low-pressure side.

The control gap and the piston are positioned in such a way and, in the case of the piston, movable in such a way that the control gap is not closed by the piston at any time. The piston thus does not close the control gap in the idle position or in the end position or in a position between the idle position and the end position.

It may further be provided that the piston has a chamfer on the high-pressure-side end face, which has the same angle of inclination as the opening.

As a result, the contour of the opening is preferably elongated by the chamfer of the piston in the idle position.

In the event that the piston is at least partially arranged above the open in its idle position, this achieves the fact that improved hydrodynamics results in the area of the opening during the through-flow through the control gap.

In one refinement of the recoil brake, it may be provided that the recoil brake has a stop element arranged on the piston rod for providing an end stop in an end position of the piston.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitive of the present invention, and wherein the sole FIGURE shows a schematic sectional representation of a recoil brake according to the invention.

DETAILED DESCRIPTION

The FIGURE shows a schematic sectional representation of a recoil brake 1 according to the invention. Recoil brake 1 is provided for braking recoiling masses of a barreled firearm. Recoil brake 1 includes a hollow cylinder 10, which has an interior 11 filled with a fluid. Interior 11 has a high-pressure side 14 and a low-pressure side 12.

Recoil brake 1 further comprises a control rod 40 arranged in hollow cylinder 10. Control rod 40 has an end 42, which is connected to hollow cylinder 10. Control rod 40 and hollow cylinder 10 are preferably screwed to each other for this purpose. Control rod 40 is thus not movable relative to hollow cylinder 10 in the mounted state.

Recoil brake 1 further comprises a piston rod 30, which surrounds control rod 40 and is arranged within hollow cylinder 10 for movement relative to hollow cylinder 10 and control rod 40 in an axial direction A of hollow cylinder 10. As is apparent from FIG. 1, piston rod 30 is a tubular component, in which control rod 40 is arranged.

Hollow cylinder 10 of the recoil brake 1 is connected to a cradle of the barreled firearm, and piston rod 30 is connected to the recoiling masses of the firearm. However, it is also alternatively possible that hollow cylinder 10 is connected to the recoiling masses of the firearm, and piston rod 30 is connected to the cradle.

A piston 20, which is displaceable in axial direction A, is further arranged within hollow cylinder 10. The outer diameter is dimensioned in such a way that it is slightly smaller than the inner diameter of hollow cylinder 10, so that they form a clearance fit, which makes it possible for piston 20 to be displaceable in axial direction A within hollow cylinder 10. Piston 20 further includes seals, so that it is sealed against hollow cylinder 10 at its outer diameter.

Piston rod 30, which is displaceable relative to the piston, is supported within piston 20, so that piston 20, which is arranged for displacement in axial direction A and fluidically separates high-pressure side 14 from low-pressure side 12, is formed on piston rod 30. Piston 20 is displaceable axially along piston rod 30 between an idle position R and an end position E.

A stop element 50 is also arranged on piston rode 30 at one end for providing an end stop in an end position E of piston 20. Stop element 50 is also used to hold an elastic 16 on piston rod 30 and to provide an end stop for elastic 16.

The other side of the elastic 16 is supported on piston 20 and ensures that the latter may have a defined pretension with respect to stop element 50. In an example, the elastic 16 can be, for example, a spring. For this purpose, stop element 50 is, for example, screwed onto piston rod 30 or secured by a screw.

Piston 20, which is arranged for displacement in axial direction A and fluidically separates high-pressure side 14 from low-pressure side 12, is formed on piston rod 30. Piston 20 is displaceable axially along piston rod 30 between an idle position R and an end position E. Idle position R defines a position of piston 20 before a bullet is fired, and end position E of piston 20 is defined by stop element 50 arranged on piston rod 30. Piston 20 and piston rod 30 are furthermore axially displaceable together relative to hollow cylinder 10.

Piston 20 fluidically separates high-pressure side 14 from low-pressure side 12 in such a way that no fluidic communication between high-pressure side 14 and low-pressure side 12 through piston 20 is formed, in particular in an area B between an outer contour of piston rod 30 and an inner contour of hollow cylinder 10. Instead, the fluid for fluidic communication must flow through a control gap 34, which connects high-pressure side 14 to low-pressure side 12.

Control gap 34 is formed within piston rod 30, in particular between piston rod 30 and control rod 40. Piston rod 30 has at least one opening 32, which connects high-pressure side 14 and control gap 34 to each other, opening 32 being arranged in front of idle position R of piston 20. Alternatively, the at least one opening 32 may also be arranged in such a way that it is only exposed by the displacement of piston 20 on piston rod 30.

The other side of control gap 34 is connected to low-pressure side 12 via a further opening, so that control gap 34 connects high-pressure side 14 and low-pressure side 12 to each other.

A distance L by which piston 20 is axially displaceable in axial direction A, is at least as great as the recoil distance of the recoiling masses during a passage of a bullet through the barreled firearm, i.e. the distance covered by the recoiling masses until the bullet leaves the firearm barrel.

While the firearm barrel is being braked by recoil brake 1, and piston rod 30, together with piston 20, is moving through hollow cylinder 10, the pressure is higher on high-pressure side 14 than on low-pressure side 12.

Piston 20 has two essentially radially running end faces 22, 24. One of the two end faces 22, 24 is a high-pressure-side end face 24, whose entire end face 24 corresponds to high-pressure side 14 in an idle position R. The other end face is a low-pressure-side end face 22, which corresponds to low-pressure side 12 at all times.

Piston 20 has a chamfer 28 on high-pressure-side end face 24, which has the same angle of inclination as opening 32. Contour 33 of opening 32 is elongated by chamfer 28 of piston 20 in idle position R illustrated in FIG. 1.

Low-pressure-side end face 22 has a groove, in which the elastic 16 is supported.

If a bullet is fired and moves through the barrel, the recoiling mass of the barreled firearm recoils. Piston rod 30, which is also connected to the recoiling parts of the barreled firearm, also recoils, so that piston rod 30 is displaced relative to piston 20 within hollow cylinder 10 of recoil brake 1 in axial direction A. Piston 20 remains in its position, due to its inertia of mass. This relative displacement continues while the bullet moves through the barrel. Distance L by which piston 20 is axially displaceable on piston rod 30 is dimensioned in such a way that piston rod 30 moves relative to piston 20 for the entire length of time needed by the bullet to pass through the firearm barrel, and the recoiling mass may recoil without being braked. In other words, the size of distance L between idle position R and end position E of piston 20 on piston rod 30 is selected in such a way that the bullet has left the firearm barrel before piston 20 rests against stop element 50.

The elastic 16, which may be designed as a spring, in particular as a pressure spring, is compressed while piston 20 is recoiling on piston rod 30. Only when the bullet has left the firearm barrel does piston 20 reach stop element 50 and is carried along by piston rod 30, so that piston 20 and piston rod 30 move together through hollow cylinder 10 of recoil brake 1 from this point in time on, and the braking effect of recoil brake 1 sets in. For this purpose, the fluid is pressed through the at least one opening 32 in piston rod 30 by control gap 34 from high-pressure side 14 to low-pressure side 12, whereby the brake pressure builds up and the braking force of the recoil brake is generated.

To the extent that the above disclosure relates to a recoil brake 1 as such, it is also considered to be simultaneously disclosed for a barreled firearm including a recoil brake 1 of this type.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A recoil brake for braking recoiling masses of a barreled firearm, the recoil brake comprising:

a hollow cylinder, which has an interior filled with a fluid;

a control rod arranged in the hollow cylinder that has an end connected to the hollow cylinder;

a piston rod that surrounds the control rod and is arranged within the hollow cylinder for movement in an axial direction of the hollow cylinder; and a piston is formed on the piston rod and is arranged for displacement in the axial direction and fluidically separates a high-pressure side from a low-pressure side of the interior, wherein a control gap is formed within the piston rod in between an inner surface of the piston rod and an outer surface of the control rod, the control pap connecting the high-pressure side and the low-pressure side, wherein the piston rod has at least one opening, which connects the high-pressure side and the control gap to each other, the at least one opening being arranged in front of an idle position of the piston, and wherein the control gap communicates with the high-pressure side and the low-pressure side in the idle position of the piston.

2. The recoil brake according to claim 1, wherein the piston fluidically separates the high-pressure side from the low-pressure side such that a fluidic communication between the high-pressure side and the low-pressure side through the piston is prevented in an area between an outer contour of the piston rod and an inner contour of the hollow cylinder.

3. The recoil brake according to claim 1, wherein a distance, by which the piston is axially displaceable in the axial direction, is at least as great as a recoil distance of the recoiling masses during a passage of a bullet through the barreled firearm.

4. The recoil brake according to claim 1, wherein the piston has two essentially radially running end faces.

5. The recoil brake according to claim 4, wherein one of the two end faces of the piston is a high-pressure-side end face, whose entire end face corresponds to the high-pressure side in the idle position of the piston.

6. The recoil brake according to claim 5, wherein another one of the two end faces of the piston is a low-pressure-side end face, whose entire end face corresponds to the low-pressure side at all times.

7. The recoil brake according to claim 1, wherein the piston rod has an essentially cylindrical outer contour over an entire length.

8. The recoil brake according to claim 1, wherein the piston has a chamfer on a high-pressure-side end face, which has a same angle of inclination as the at least one opening.

9. The recoil brake according to claim 1, further including a stop element arranged on the piston rod for providing an end stop in an end position of the piston.

10. A barreled firearm comprising at least one of the recoil brake according to claim 1.

11. A recoil brake for braking recoiling masses of a barreled firearm, the recoil brake comprising:

a hollow cylinder, which has an interior filled with a fluid;

a control rod arranged in the hollow cylinder that has an end connected to the hollow cylinder;

a piston rod that surrounds the control rod and is arranged within the hollow cylinder for movement in an axial direction of the hollow cylinder; and a piston is formed on the piston rod and is arranged for displacement in the axial direction and fluidically separates a high-pressure side from a low-pressure side of the interior, wherein a control gap is formed within the piston rod in between an inner surface of the piston rod and an outer surface of the control rod, the control gap connecting the high-pressure side and the low-pressure side, wherein the piston rod has at least one opening, which connects the high-pressure side and the control gap to each other, and wherein the piston is displaceable between an idle position and an end position and the control gap is not closed by the piston when the piston is in the idle position, the end position or a position between the idle position and the end position.

* * * * *